US006105170A

United States Patent [19]

Lisciandro et al.

[11] Patent Number: 6,105,170

[45] Date of Patent: Aug. 22, 2000

[54] CHILDCARE VEST

[76] Inventors: Gregory R. Lisciandro; Stephanie C. Lisciandro, both of 20114 Park Ranch, San Antonio, Tex. 78259

[21] Appl. No.: 09/391,009

[22] Filed: Sep. 7, 1999

Related U.S. Application Data

[63] Continuation-in-part of application No. 09/132,160, Aug. 10, 1998.

[51] Int. Cl.[7] ..... A41D 1/00; A41D 1/04; A41D 1/20

[52] U.S. Cl. ..... 2/102; 2/94; 2/104

[58] Field of Search ..... 2/48, 49.1, 49.2, 2/49.3, 51, 94, 95, 102, 104; 224/153, 155, 156

[56] References Cited

U.S. PATENT DOCUMENTS

| | | | |
|---|---|---|---|
| 4,475,251 | 10/1984 | Hopkins | 2/94 |
| 4,669,127 | 6/1987 | Swanson | 2/46 |
| 4,706,856 | 11/1987 | Jacober | 224/151 |
| 4,713,842 | 12/1987 | Patterson | 2/104 |
| 4,873,725 | 10/1989 | Mitchell | 2/48 |
| 5,031,244 | 7/1991 | Inagaki | 2/102 |
| 5,101,515 | 4/1992 | Holt et al. | 2/94 |
| 5,440,761 | 8/1995 | Abrams et al. | 2/102 |
| 5,526,535 | 6/1996 | Dobrzenski | 2/102 |
| 5,570,473 | 11/1996 | Andries | 2/93 |
| 5,649,658 | 7/1997 | Hoffman et al. | 224/576 |
| 5,692,237 | 12/1997 | Bennett | 2/93 |
| 5,743,448 | 4/1998 | Tsai | 224/153 |
| 5,797,143 | 8/1998 | Buxton | 2/102 |

*Primary Examiner*—John J. Calvert
*Assistant Examiner*—Shirra L. Jenkins

[57] ABSTRACT

A childcare vest is comprised of a central portion and first and second wing portions, each having, inner and outer surfaces. A first plurality of pockets is fixed to the outer surface of the wing portions where individual pockets are sized to accommodate childcare items, including baby bottles, utensils, eating accessories, specially packaged foods, and small toys. At least one second pocket that is large relatively to the first plurality of pockets is fixed across the outer surface of the central portion and sized to accommodate clothing accessories and to serve as a temporary holding for refuse. A third plurality of pockets is fixed to the wing portions and sized to accommodate diapers and diaper changing accessories. A resilient changing surface is carried by the central portion to provide a comfortable, stable, and sanitary surface for changing a baby at remote locations.

10 Claims, 5 Drawing Sheets

CHILDCARE VEST

RELATED CASES

This application is a continuation-in-part of U.S. patent application 09/132,160, filed Aug. 10, 1998.

FIELD OF THE INVENTION

This invention relates to childcare devices, and, more particularly, to apparatus for carrying childcare utilities.

BACKGROUND OF THE INVENTION

Traveling with a small child, whether running errands, making a day trip to the park, or moving long distances via auto or air, requires a variety of equipment and a great deal of preparation and organization. Bottles, bibs, infant-sized utensils, and related apparatus as well as specially prepared foods are often required before the child is able to eat adult fare. Of equal importance is ample preparation for the inconvenient and unpredictable task of diaper changing. Often the situation presents itself in non-compliant areas, e.g., far from a rest station or lavatory equipped with changing tables. Even today, many public restrooms do not have adequate changing facilities. Furthermore, in facilitating the stress of travel, some provision by the parent is usually made for entertaining the child with small objects such as rattles, small toys, and, undoubtedly, the ubiquitous pacifier.

There exists a plethora of equipment available that can be utilized for these childcare requirements. More common examples include small and large-sized diaper bags carried by either a handle or a shoulder strap. Less commonly, backpacks are used. These devices often interfere with holding a child or must be removed from the body or set down before items can be removed for adequate usage.

The present invention addresses these childcare problems and demands. Uniquely, the diaper changing childcare vest permits ready access to more commonly needed items and possesses a portable diaper changing facility. In addition to providing access to many of the vest's features without removing the garment, this innovation also permits the wearer to carry its features with both hands free for child supervision.

It is an object of the present invention to provide a carrier for access to childcare devices without having to remove the carrier for access to frequently needed items including feeding supplies, utensils, toys, change of clothes, and the like.

It is another object of the present invention to provide child diaper changing facilities that can be used at remote locations with strategic storage of diapers, sanitary wipes and other hygienic needs conveniently located adjacent to the changing surface.

Additional objects, advantages and novel features of the childcare vest described herein will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise a childcare vest. The vest is comprised of a central portion and first and wing portions, each having, inner and outer surfaces. A first plurality of pockets is fixed to the outer surface of the wing portions where individual pockets are sized to accommodate childcare items, including baby bottles, utensils, eating accessories, specially packaged foods, and small toys. At least one second pocket that is large relatively to the first plurality of pockets is fixed across the outer surface of the central portion and sized to accommodate clothing accessories and to serve as a temporary holding for refuse A third plurality of pockets is fixed to the wing portions and sized to accommodate diapers and diaper changing accessories. A folded resilient changing surface is removably fastened to the central portion to provide a comfortable, stable, and sanitary surface for changing a baby at remote locations. A flap has one end fixed to the central portion and a second end has a fastener for removably retaining the changing surface in a folded position.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION

The present invention is directed to a childcare vest that can be worn as a garment to free the hands of the wearer for supervision and care of a child. The added mobility and freedom of the wearer's hands permits the wearer to deal with the unpredictability of daily child care in an organized and timely manner so that a child's needs can be met in an organized and timely manner. These tasks are achieved by storage of the equipment and foodstuffs within the vest for ready access. Furthermore, a most unique feature consists of the provision of a portable, readily accessed diaper changing facility for a parent or supervisor on the move. The childcare vest holds diaper changing gear and provides a comfortable, stable, hygienic changing surface to facilitate successful completion of this unpredictable task at almost any reasonable location.

Figure 1B:
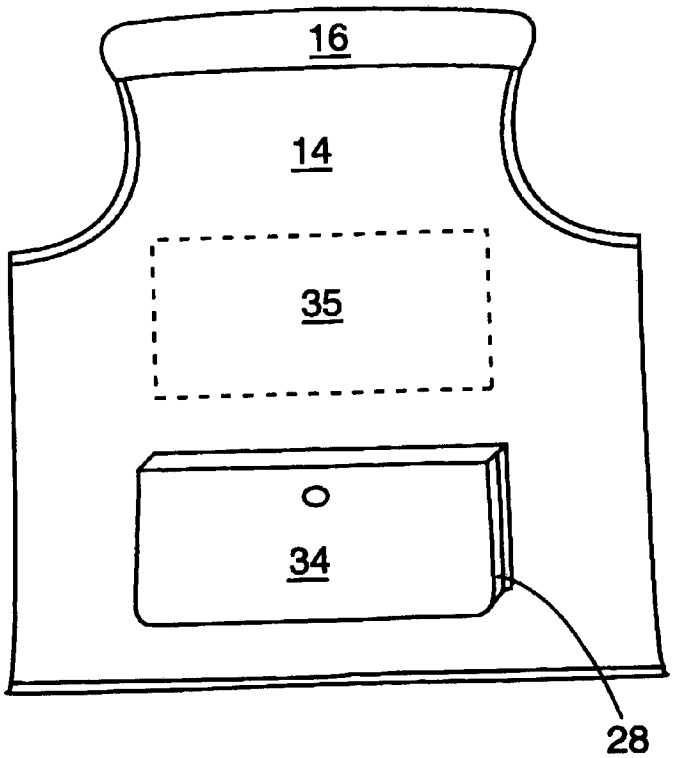
FIG. 1B is a back view of the outside surface of a childcare vest shown in FIG. 1A.
Figure 1A:
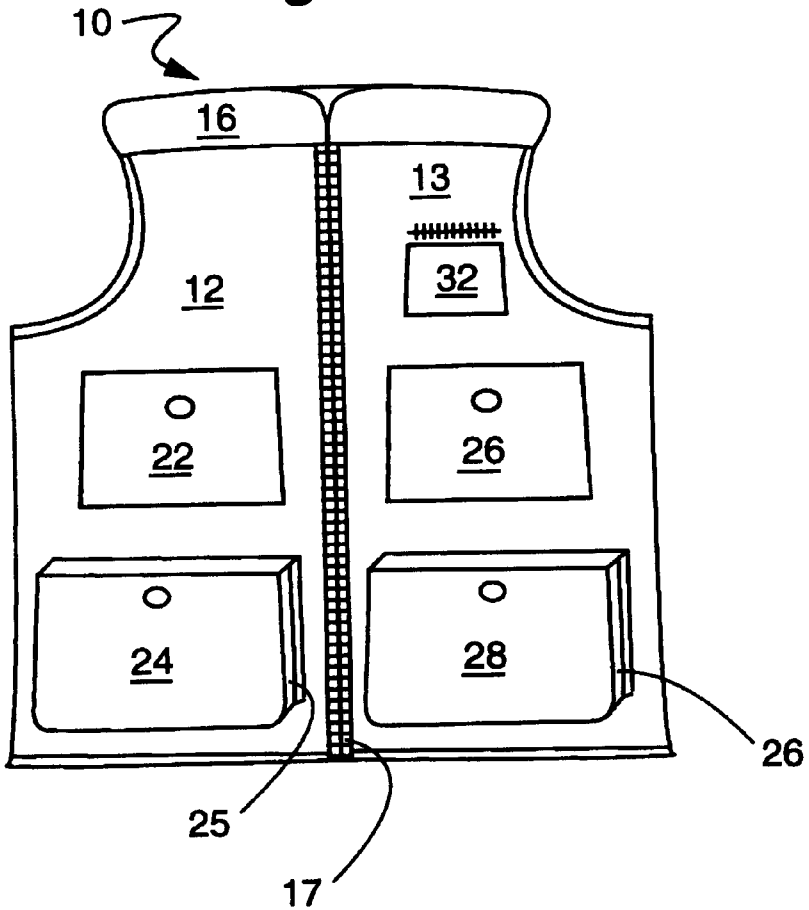
FIG. 1A is a front view of the outside surface of a childcare vest according to one embodiment of the present invention.

Referring first to FIGS. 1A and 1B, there is shown childcare vest 10 with first and second wing portions 12, 13 and central portion 14 and with a conventional collar 16 and front closing opening 17. Vest 10 is shown without sleeves, but sleeves could be included, if desired. First and second wing portions 12, 13 are provided with a variety of pockets on an outer surface that are arranged for ready access to accessories that are typically used more frequently during the day, while central portion 14 is used for less frequently used accessories, such as extra clothing, change of clothes, or temporary holding of refuse.

FIG. 1A depicts a particular arrangement of accessory pockets. The exact location of the pockets on first and second wing portions 12, 13 is not critical and the pockets may be organized as desired. But the pockets on the outer surface of first wing portion 12 are configured to carry frequently used accessories such as bottles, bottle accessories (nipples, liners, pacifiers, and the like), bibs, eating utensils, specialty food, and the like. Thus, pocket 22 is provided for bottle accessories and pocket 24 is sized to carry one or more bottles and may incorporate devices, such as elastic loops, for securing bottles within the pocket. In one embodiment, pocket 26 is formed from a mesh material so that damp garments can be placed in the pocket with access to a drying airflow. Pocket 28 is then sized to accommodate eating equipment, such as bibs, utensils, and food for the child. Pockets 24, 28 may be formed with side pleats 25, 26, respectively, to provide an expandable storage volume. If desired, extra pockets, such as pocket 32, may be included for holding personal items of the wearer.

Central portion 14 of vest 10 is not as readily accessible to the wearer as first and second portions 12, 13. But a wearer can access a relatively large storage area, such as pocket 34, that is placed low enough for the arms to fold around and reach. Since central portion 14 does not have to provide for opening vest 10, an oversize pocket can be readily provided that can extend much of the way around the back of vest 10 to store larger items, such as a change of clothing, extra clothing, or specialty clothing like a bathing suit. It will be appreciated that pocket 34 may have a fastener to secure the top, but may also be left open or have an elastic band for closure. Pleated sides 29 may be provided to form an expandable volume. Pocket 34 might be placed at the top of back surface 14 for over-the-shoulder access, but the lower position is preferred. Additional storage pockets 35 along central portion 14 may be added to complement pocket 34, depending on the selected diaper changing embodiments, discussed below.

In a particular feature of the present invention, inner surface 40 of vest 10 provides diaper change facilities. Pockets 44 and 48 may be located on the inner surface of first and second wings 12, 13, and contain a supply of diapers, diaper wipes, lotion, powder, and other supplies for providing a diaper change. Selected pockets, such as pockets 44 and 48, may be formed with pleats 45 and 47, respectively, to provide expandable volumes. Additional pockets 42, 46 may be provided for personal articles or auxiliary materials.

Since the need for a diaper change may occur at inconvenient location, changing pad 54 (FIG. 2B) is folded within holding pocket 52. Thus, vest 10 is simply removed and laid on the ground or other convenient surface and changing pad 54 is unfolded to provide a secure, comfortable, and clean surface for diaper changing. Changing pad 54 may be fastened, e.g., by VELCRO fasteners 49, or self-contained within vest 10 or may be a removable pad of conformable material, such as foam, batting, or the like, or may be a small inflatable/deflatable pad that is not as bulky as material padding. When changing pad 54 is fastened to the inner surface 40 of central portion 14 with VELCRO fasteners 49, pad extends the length of central portion 14 and is fastened longitudinally at each end to secure pad 54 to central portion 14. Wing portions 12, 13 extend laterally from central portion 14 to provide ready access to the diaper change accessories carried by pockets 42, 44, 46, and 48. Pad 54 is preferably covered with a waterproofed material. Inner surface 40 of vest 10 also is formed preferably with a waterproofed surface.

Figures 2A, 2B:
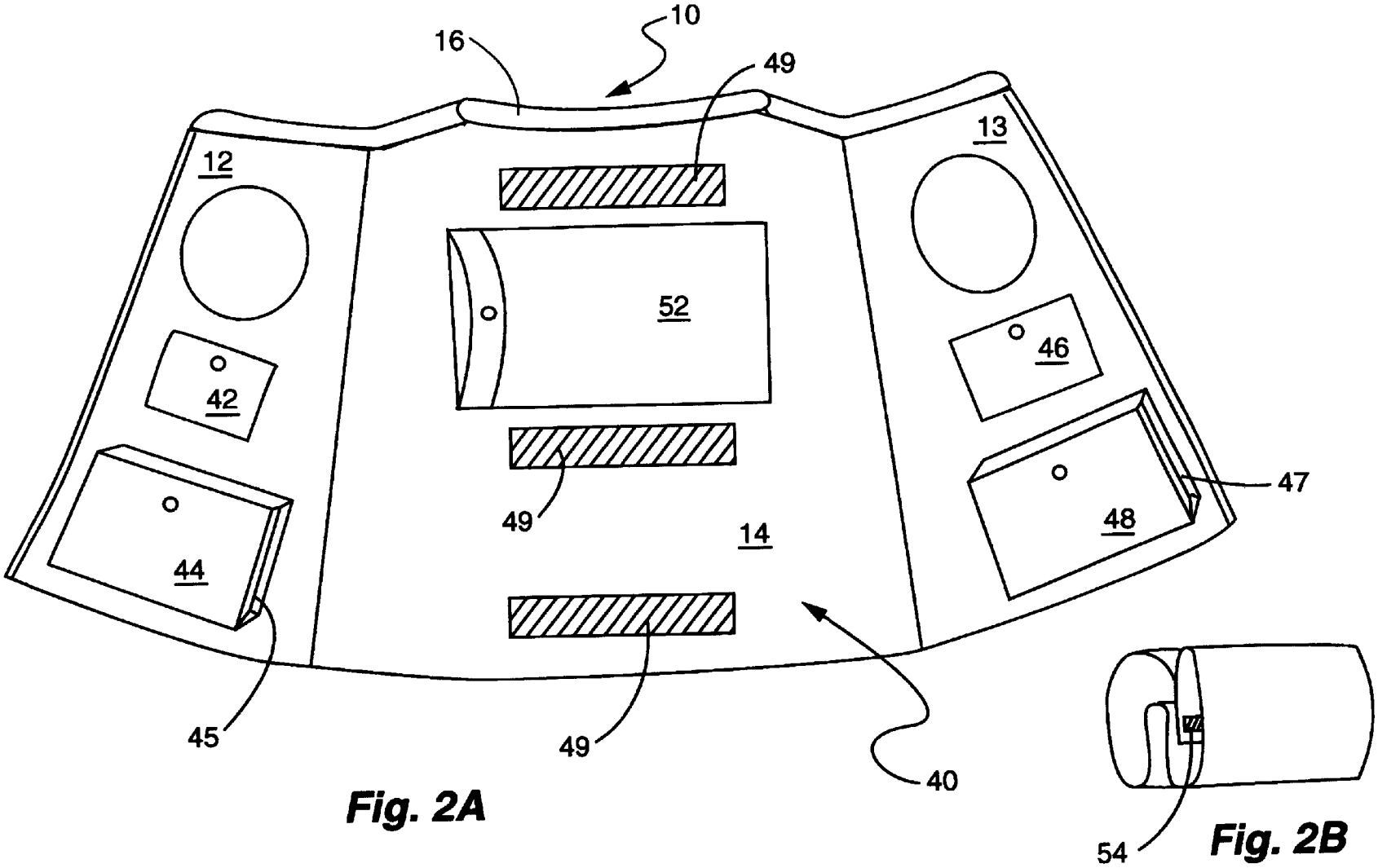
FIG. 2A is a view of the interior surface of a childcare vest shown in FIG. 1A.
FIG. 2B is a pictorial view of a diaper change pad that is incorporated with the childcare vest.

Childcare vest 10 may be constructed from a multitude of fabrics and material depending of the geographic locale and intended use by the wearer. Exemplary materials include 100% cotton, a cotton blend, water resistant/proofed materials, and even mesh fabric for hot weather use. Pocket closures may be provided from conventional fasteners, such as buttons, snaps, or VELCRO closures for ease of opening and closing with one hand, or may be closed by an elastic strap, or the like, across the top. Pockets 24, 28 (both FIG. 1A), 34 (FIG. 1B), 44 and 48 (FIG. 2A) that hold bulky items are preferably pleated in order to provide expansion to accommodate thicker/wider objects, as shown in FIGS. 1A, 1B, and 2A.

Figure 3A:
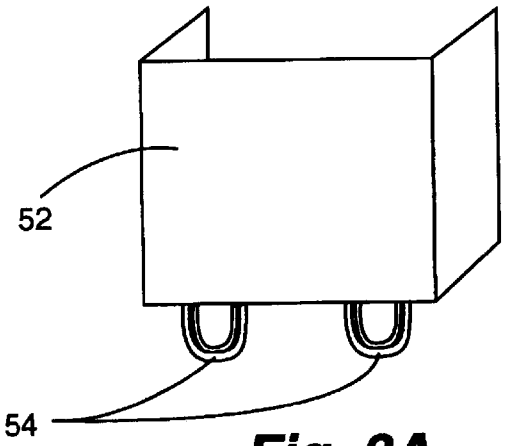
FIGS. 3A–3E are pictorial illustrations of pocket configurations that may be incorporated on the vest shown in FIGS. 1A, 1B, and 2A.
Figure 3B:
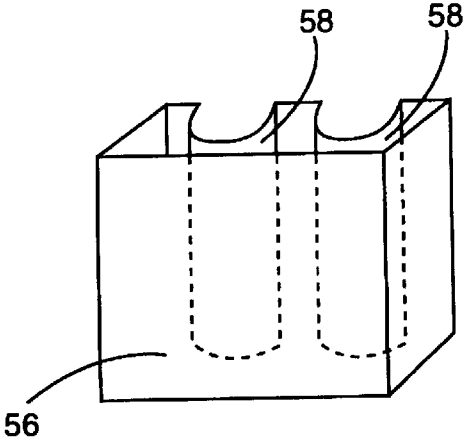
Figure 3C:
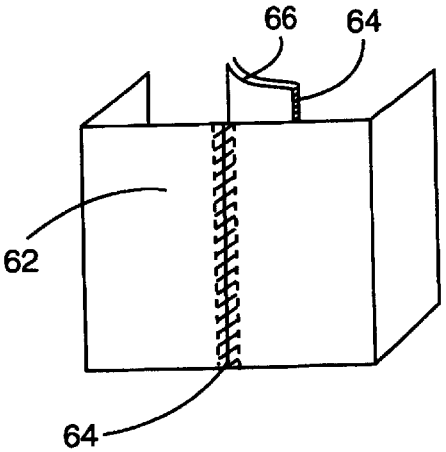
Figure 3D:
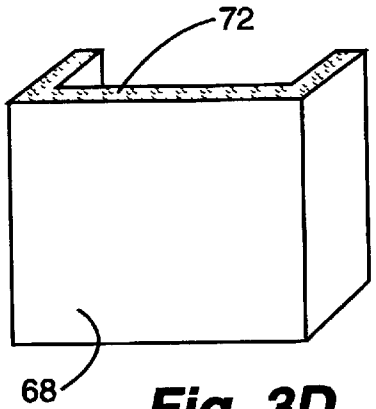
Figure 3E:
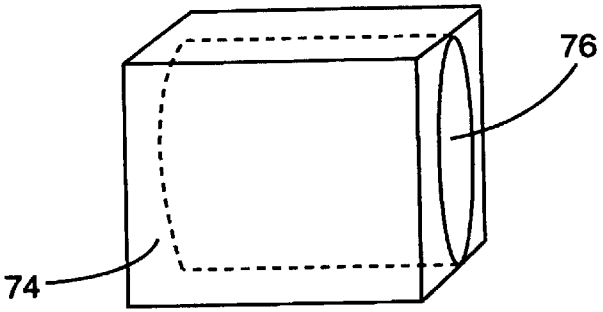

FIGS. 3A–3E depict a variety of possible pocket designs for use with the childcare vest. FIG. 3A depicts pocket 52 formed with attachment rings 54 for connecting appropriate accessories. FIG. 3B depicts pocket 56 with internal pockets 58 for organizing and supporting appliances, such as milk bottles or food jars. FIG. 3C depicts pocket 62 with a removable divider 66 that may be fastened with, e.g., mating VELCRO fastener strips 64, to pocket 62. FIG. 3D depicts pocket 68 with insulating liner 72 to help maintain the temperature of stored items. FIG. 3E depicts pocket 74 formed with a sleeve-type opening 76 for easy interior access.

Figure 4B:
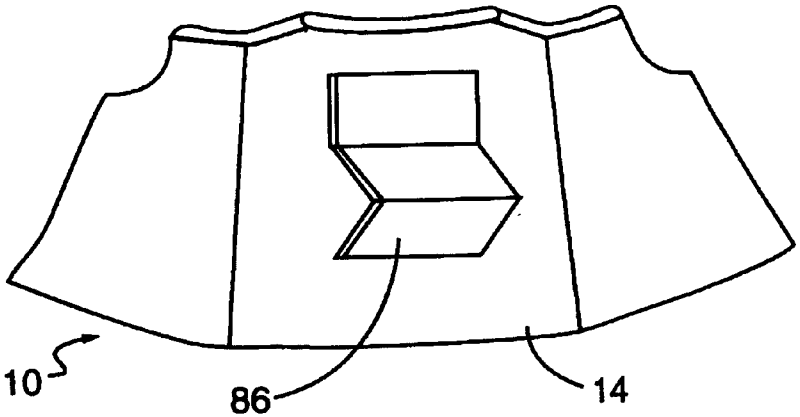
FIGS. 4A and 4B are pictorial illustrations of embodiments of a resilient surface carried by the central portion of the vest.
Figure 4A:
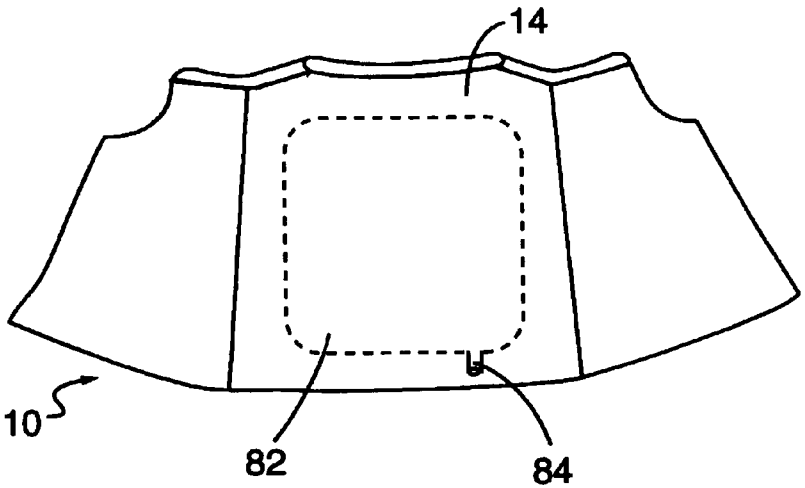

FIGS. 4A and 4B depict further embodiments of a resilient surface carried by either the inside or outside surface of central portion 14 of vest 10. FIG. 4A depicts an internal resilient volume 82 that may be inflatable through an external nozzle 84 or may be a resilient material of any one of a number of known materials. FIG. 4B depicts resilient pad 86 that is fixed to a surface of central portion 14 and is simply unfolded to expand and form a suitable changing surface.

Figure 5A:
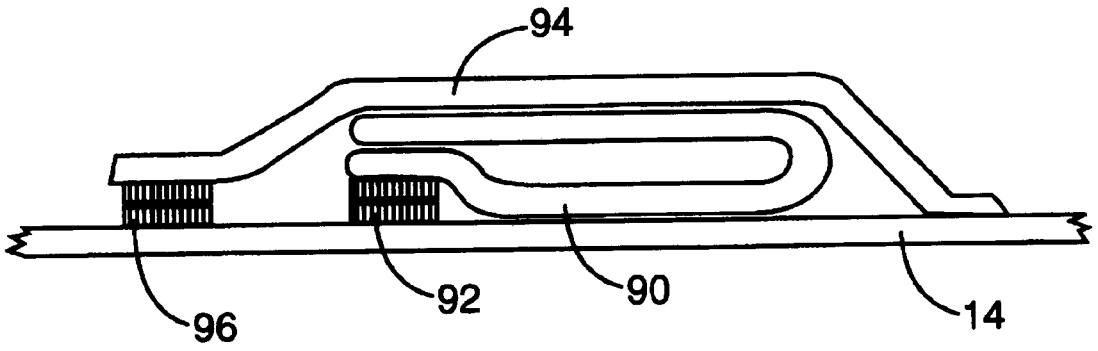
FIGS. 5A and 5B are sideviews of flaps for retaining a changing surface in a folded position.
Figure 5B:
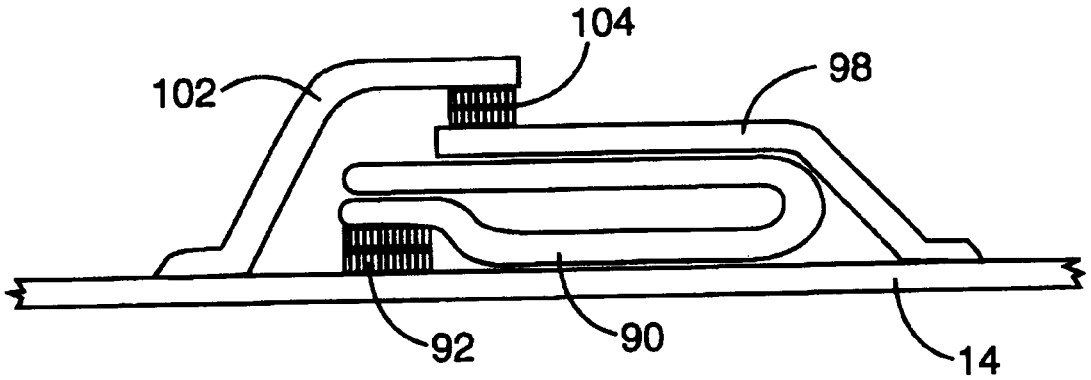

In a particular feature of the present invention, the changing surface can be deployed while the wearer is carrying the infant. As shown in FIGS. 5A and 5B, a changing pad 90 is releasably attached to central portion 14 so that changing pad 90 can be folded for carrying. Changing pad 90 is held to central portion 14 by a releasable fastener 92, which is preferably a VELCRO fastener, but snaps could also be used. Changing pad 90 is retained in a folded position by a flap, such as single flap 94 shown in FIG. 5A, a double flap shown in FIG. 5B, or the like.

Single flap 94 is fixed to central portion 14 at one end and has a releasable fastener 96 at the second end. Double flap 98, 102 has each flap portion 98, 102 fixed to central portion 14 at one end and with mating fastener 104 at a second end. Fasteners 96 and 104 are prefereably VELCRO fastener, but could be snaps, buttons, or the like.

A user, thus, readily can release the covering flap with one hand while the changing pad is retained to the central portion of the childcare vest and then unfold the changing pad with one hand while retaining the infant with the other hand. The flaps are preferably waterproof so that the changing pad can be refolded within the flap after the infant has been changed.

The foregoing description of the childcare vest according to this invention has been presented for purposes of illustration and description and is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A childcare vest comprising, in combination:

a garment having a central portion and first and second wing portions, each having inner and outer surfaces;

a plurality of first pockets fixed to the outer surface of the wing portions, where individual ones of the first pockets are sized to accommodate childcare items including baby bottles, eating accessories, small toys;

at least one second pocket that is large relative to the first pockets and is fixed across the outer surface of the central portion and sized to accommodate clothing accessories or refuse;

a plurality of third pockets fixed to the inner surface of the wing portions where individual ones of the third pockets are sized to accommodate diapers and childcare diaper changing accessories; and an inflatable changing surface carried by the central portion to provide a secure, comfortable, changing surface for a child.

2. A childcare vest according to claim 1, wherein at least one of the plurality of first pockets is formed of a mesh fabric.

3. A childcare vest according to claim 1, wherein the first and third pockets contain dividers, small pockets within, or insulating linings for temperature control of food stuffs.

4. A childcare vest according to claim 1, wherein the second pocket is positioned on the outer surface of the central portion to be accessible by a person while wearing the vest.

5. A childcare vest according to claim 1, wherein the changing surface is carried by the outer or inner surface of the central surface.

6. A childcare vest comprising, in combination:

a vest having a central portion and first and second wing portions extending laterally from the central portion, each having inner and outer surfaces;

a folded resilient changing pad carried on the inner surface of the central portion in a first folded position and movable to a second unfolded position extending the length of the central portion.

7. The childcare vest of claim 6, further including a plurality of pockets fixed to the inner surface of the wing portions where individual ones of the pockets are sized to accommodate diapers and childcare diaper changing accessories.

8. The childcare vest of claim 7, further including a pocket on the inner surface of the central portion for carrying the changing pad in the first folded position.

9. The childcare vest of claim 8, further including fasteners fixed to the inner surface of the central portion at longitudinal ends of the central portion for fastening the changing pad along the length of the central portion in the second unfolded position.

10. A childcare vest comprising, in combination:

a garment having a central portion and first and second wing portions, each having inner and outer surfaces;

a plurality of first pockets fixed to the outer surface of the wing portions, where individual ones of the first pockets are sized to accommodate childcare items including baby bottles, eating accessories, small toys and at least one of the first pockets if formed of a mesh fabric;

at least one second pocket that is large relative to the first pockets and is positioned on the outer surface of the central portion to be accessible by a wearer of the vest and is sized to accommodate clothing accessories or refuse;

a plurality of third pockets fixed to the inner surface of the wing portions where individual ones of the third pockets are sized to accommodate diapers and childcare diaper changing accessories;

wherein individual ones of the first and third pockets contain dividers, small internal pockets, or insulating liners for temperature control of food stuffs;

a folded resilient changing surface formed of a resilient material having a waterproof surface and removably fastened to the inner surface of the central portion to provide a secure, comfortable, changing surface for a child; and a flap having one end fixed to the central portion and a second end having a fastener releasably attached to the central surface, the flap retaining the changing surface in a folded position.

* * * * *